United States Patent [19]

Schumacher

[11] 3,939,669

[45] Feb. 24, 1976

[54] COMBINATION LIQUID TRAPPING SUCTION ACCUMULATOR AND EVAPORATOR PRESSURE REGULATOR DEVICE INCLUDING A DRIER AND THERMOSTATIC EXPANSION VALVE

[75] Inventor: Ernest W. Schumacher, Portsmouth, Va.

[73] Assignee: Virginia Chemicals Inc., Portsmouth, Va.

[22] Filed: Oct. 30, 1974

[21] Appl. No.: 519,305

Related U.S. Application Data

[62] Division of Ser. No. 388,281, Aug. 14, 1973, Pat. No. 3,858,407.

[52] U.S. Cl. ..... 62/217; 62/503

[51] Int. Cl.[2] ..... F25B 49/00

[58] Field of Search ..... 62/217, 503, 196, 474, 62/471, 222

[56] References Cited

UNITED STATES PATENTS

| | | | |
|---|---|---|---|
| 3,525,234 | 8/1970 | Widdowson | 62/217 |
| 3,796,064 | 3/1974 | Ladusaw | 62/503 |
| 3,798,921 | 3/1974 | Scherer et al. | 62/503 X |

*Primary Examiner*—William E. Wayner

[57] ABSTRACT

A combination liquid trapping suction accumulator and evaporator pressure regulator device used intermediate the compressor and evaporator in a vapor-compression refrigeration system as a protective device for the compressor. The device is characterized by the positioning of the evaporator pressure regulator chamber intermediate the inlet and outlet ports of the accumulator housing. Thus, evaporator pressure regulation is accomplished simultaneously with liquid accumulation in a compact and readily serviceable, unitary housing.

2 Claims, 2 Drawing Figures

COMBINATION LIQUID TRAPPING SUCTION ACCUMULATOR AND EVAPORATOR PRESSURE REGULATOR DEVICE INCLUDING A DRIER AND THERMOSTATIC EXPANSION VALVE

CROSS REFERENCE TO RELATED APPLICATION:

A modification of the assignee's earlier filed application entitled LIQUID TRAPPING SUCTION ACCUMULATOR (Serial No. 359,569), filed May 11, 1973 this application is a division of U.S. Ser. No. 388,281 filed Aug. 14, 1973, now U.S. Pat. No. 3,858,407.

The present application is characterized in its combining of an evaporator pressure regulator device with a liquid trapping suction accumulator.

BACKGROUND OF THE INVENTION:

Automobile air conditioning and refrigeration systems are conventionally subject to a high rate of failure, due principally to liquid entering the compressor. These failures frequently occur after a short shut-down of the automobile which defeats the thermostatic expansion valve, permitting liquid to migrate from the condenser into the evaporator. As the automobile air conditioning system is restarted, the liquid goes to the compressor with damaging results. The automobile system is characterized by the extraordinarily wide range of flow rates, a principal aim being to return the oil through the eductor, regardless of flow rate.

Liquid suction accumulators are widely employed to solve the problem of liquid entering the compressor. However, there is no prior art showing a combination of these elements within a single working system and utilizing pressure drops obtained, for example, through the evaporator pressure regulator as an assistance in the eduction of oil through the sytem.

SUMMARY OF THE INVENTION

According to the present invention, an evaporator pressure regulator (EPR) is interposed between the inlet and outlet ports of an accumulator chamber. The evaporator pressure regulator (EPR) may include an evaporator pressure regulator device of the bellows or other type, regulating vaporous flow from inlet to outlet, according to pressure within the system. The pressure drop obtained through the evaporator pressure regulator device is utilized in drawing oil through the eductor tube.

Modification of the invention includes positioning of an expansion valve within the accumulator housing, use of a combined thermostatic expansion valve and a filter drier adjacent to the accumulator chamber, positioning of both the expansion valve and a desiccant within the accumulator chamber, utilization of a fixed orifice or capillary feeding device intermediate the filter drier and the evaporator in the system, positioning of the evaporator pressure regulator device perpendicularly with respect to the top of the accumulator chamber and providing the evaporator pressure regulator chamber with quick disconnects, fitting and sealing fixtures. According to the particularly claimed species of FIG. 2 herein the vertically extending accumulator chamber includes a pressure responsive evaporator pressure regulator vertically positioned in the evaporator pressure chamber proximate the outlet port. A vertically extending eductor tube extends independently from the bottom of said accumulator chamber into the evaporator pressure chamber regulator chamber to efficiently allow only the pressure drop across the EPR to be effective for positive oil return. A further advantageous feature of the construction of FIG. 3 is the provision of a vertically suspended filter drier casing removably threaded to a separate drier and thermostatic valve subassembly. The subassembly includes a horizontally disposed entrance port 20 and horizontally disposed exit port 21. The filter drier casing 16 is threaded at 22 with further sealing by O-ring 23. The single pressure drop across the EPR controls both the EPR and the eductor; liquid oil is thereby allowed to rise in the eductor tube as a function only of the refrigerant compression pressure. Thus the structure of FIG. 3 ensures that the EPR is able to reliably keep liqiod refrigerant out of the compressor while allowing entry of liquid oil.

Figure 1:
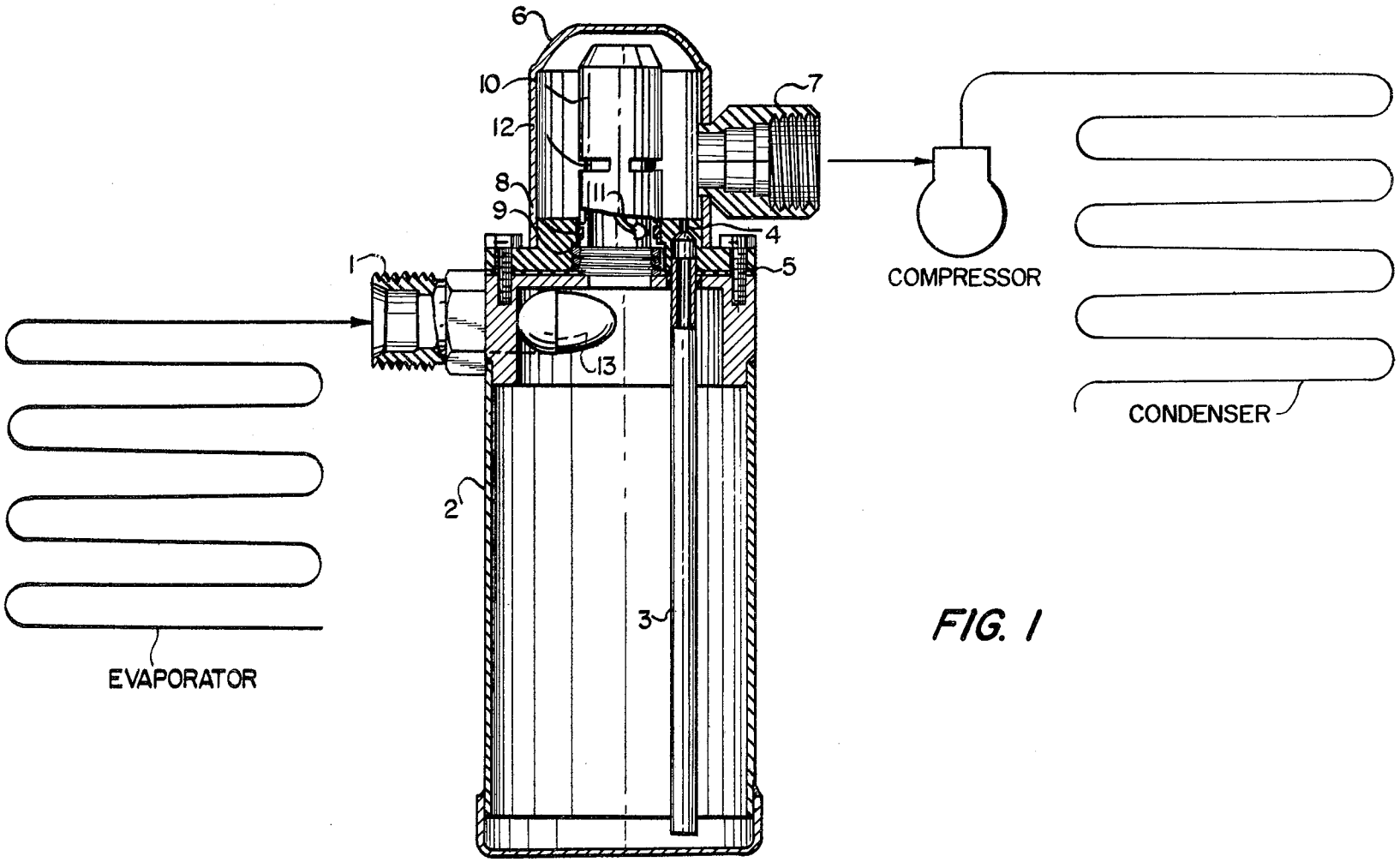
FIG. 1 is a schematic view, partially in vertical section, showing a combined evaporator pressure regulator chamber and accumulator, according to the present invention.

DESCRIPTION OF THE PREFERRED EMBODIMENTS:

The primary function of a suction accumulator is to prevent liquid refrigerant from entering the compressor. It must also provide positive oil return at all system flow rates. Conventional accumulators are designed to provide adequate pressure drop for positive oil return at minimum system flow rates. However, when systems experience high maximum to minimum flow rate ratios, accumulator pressure drops at high load conditions become excessive. The combining of the EPR and accumulator can solve this problem. The EPR represents a finite pressure drop in the suction line at all operating conditions. In fact, the pressure drop across the EPR is generally greatest at low loads. Integration of the accumulator and the EPR allows the pressure drop across the EPR to be utilized for positive oil return. This arrangement allows the accumulator to be designed for minimum pressure drop while still performing its liquid trapping function. In FIG. 1 the refrigerant-oil mixture is shown entering the accumulator vessel 2 at inlet connection 1. Oil is returned through eductor tube 3 which is connected to outlet orifice 4. Orifice 4 is arranged to bypass the EPR 10, hence taking advantage of its pressure differential for oil return. The oil is mixed with the refrigerant vapors exiting the EPR 10 in chamber 6 and returned to the compressor through outlet connection 7. O-ring 8 provides a positive seal between the inlet and outlet of EPR 10 and compression spring 9 provides positive retention of the EPR 10 in its socket. EPR may be of the bellows-type containing an inert gas such as nitrogen which is charged through nipple 11. Pressure changes move the bellows which moves a spool or slide across peripheral slots 12, so as to regulate vaporous flow. A tangential entry device 13 may be positioned adjacent inlet connection 1, to provide consistent liquid and vapor separation.

Figure 2:
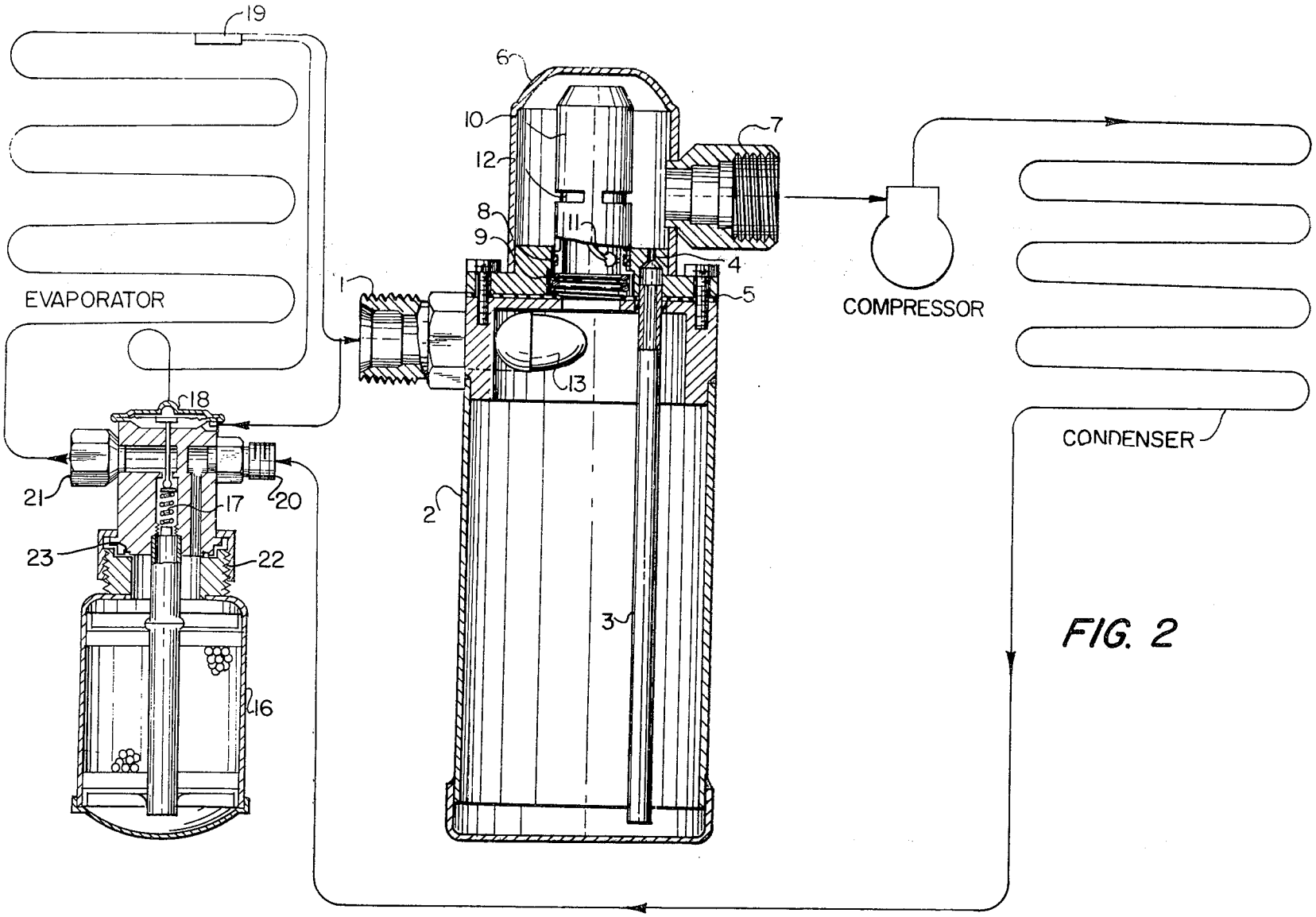
FIG. 2 is a schematic view, partially in vertical section, showing a further modification wherein a combined filter drier and thermostatic expansion valve unit have been interposed between the condenser and the evaporator system.

FIG. 2 schematically shows the combination EPR-accumulator (described in FIG. 1) in a complete system, including a separate filter-drier or receiver-drier 16 with a desiccant mounted therein. However, the receiver-drier is no longer fully required, since the accumulator can perform the liquid storage function for which the receiver was previously required. A thermostatic expansion valve 17 may be positioned intermediate filter-drier 16 and the evaporator. Two additional advantages are also obtained with this arrangement. First, loss of liquid subcooling, which normally occurs in a receiver, may be reduced. The much smaller filter-drier 16 is always liquid full, which enables it to better retain any subcooling obtained in the condenser. In fact, filter-drier 16 may provide additional subcooling, if it can be located in an ambient somewhat below condensing temperature. The second advantage is that evaporator performance can be improved, since proper control arrangement will allow "over-feeding" of the evaporator without risk of liquid entering the compressor.

This system, according to FIG. 3 further advantageously includes the expansion valve and filter-drier as a combined unit 16. Since the filter-drier is a much smaller package than the receiver-drier, its choice of location is broadened considerably. Though no performance advantages accrue with this arrangement, it does require fewer plumbing connections and allows ease of filter-drier replacement, a critical characteristic in miniaturized automobile air conditioning systems. The desiccant within filter drier 16 is conventional. As further illustrated, the expansion valve subassembly in the combination includes compression spring 17, and diaphragm 18 which includes connection to both external termperature sensing bulb 19 and an external equalizer connection at inlet 1. This separately positionable combination of a thermostatic expansion valve and a filter drier herein ensures maximum flexibility for positioning of accumulator 2 within the entire system.

I claim:

1. A liquid trapping suction accumulator adapted for insertion in a vapor-compression regrigeration system between the evaporator and compressor, comprising:

A. an accumulator chamber defined by a casing vertically extending and having a top and a bottom;

B. inlet and outlet ports opening into the top of said chamber and respectively adapted for operative connection to said evaporator and said compressor;

C. an evaporator pressure regulator chamber interposed between said inlet and outlet ports in communication with said accumulator chamber, said chamber including:

i. a pressure responsive evaporator pressure regulator device, vertically positioned in said evaporator pressure chamber proximate said outlet port, so as to gauge admission of vapor through said evaporator pressure regulator chamber and said outlet;

D. an eductor tube vertically extending independently from the bottom of said accumulator into said evaporator pressure regulator chamber whereby the pressure drop from said accumulator to said chamber controls both said regulator device and oil eduction;

E. a drier and thermostatic expansion valve subassembly for gauging liquid flow from said drier to said evaporator said subassembly comprising a separate thermostatic expansion valve housing having a horizontally disposed exit for refrigerant to said evaporator and including a threadably removable filter drier casing vertically suspended from said valve housing and in flow communication between said entrance and said thermostatic expansion valve within said subassembly.

2. The liquid trapping suction accumulator of claim 1 including a tangential entry device positioned in said accumulator chamber adjacent said inlet port, as an assistance in separation of liquid and vapor.

* * * * *

UNITED STATES PATENT OFFICE

CERTIFICATE OF CORRECTION

Patent No. 3,939,669 Dated February 24, 1976

Inventor(s) Ernest W. Schumacher

It is certified that error appears in the above-identified patent and that said Letters Patent are hereby corrected as shown below:

Column 1, line 37 - "sytem" should be -- system --.

Column 2, line 4 - "Figure 3" should be -- Figure 2 --.

Column 2, line 14 - "Figure 3" should be -- Figure 2 --.

Column 2, line 15 - "liqiod" should be -- liquid --.

Column 3, line 20 - "Figure 3" should be -- Figure 2 --.

Column 4, line 2 - "regrigeration" should be -- refrigeration --.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*